US008905243B2

(12) United States Patent
Dixon et al.

(10) Patent No.: US 8,905,243 B2
(45) Date of Patent: Dec. 9, 2014

(54) APPARATUS FOR SORTING OBJECTS, AND ASSOCIATED METHOD

(75) Inventors: Darrell Dixon, Clemmons, NC (US); Larry McCann, King, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 613 days.

(21) Appl. No.: 12/854,339

(22) Filed: Aug. 11, 2010

(65) Prior Publication Data

US 2012/0037546 A1 Feb. 16, 2012

(51) Int. Cl.

| | |
|---|---|
| ***B07C 5/00*** | (2006.01) |
| ***B07B 13/00*** | (2006.01) |
| ***B07B 13/10*** | (2006.01) |

(52) U.S. Cl.

CPC ..... *B07B 13/003* (2013.01); *B07B 13/10* (2013.01)

USPC ..... 209/640; 209/535

(58) Field of Classification Search

USPC ..... 209/535, 637, 638, 640

See application file for complete search history.

(56) References Cited

U.S. PATENT DOCUMENTS

| | | | | |
|---|---|---|---|---|
| 159,853 | A * | 2/1875 | Staniford | 209/637 |
| 1,376,586 | A | 5/1921 | Schwartz | |
| 2,304,554 | A * | 12/1942 | Dixon | 209/637 |
| 3,339,558 | A | 9/1967 | Waterbury | |
| 3,366,121 | A | 1/1968 | Carty | |
| 3,390,686 | A | 7/1968 | Irby, Jr. | |
| 3,428,049 | A | 2/1969 | Leake et al. | |
| 3,547,130 | A | 12/1970 | Harlow et al. | |
| 3,575,180 | A | 4/1971 | Carty | |
| 3,602,231 | A | 8/1971 | Dock | |
| 3,625,228 | A | 12/1971 | Dock | |
| 3,635,226 | A | 1/1972 | Horsewell et al. | |

(Continued)

FOREIGN PATENT DOCUMENTS

| | | |
|---|---|---|
| DE | 10 2005 00827 | 8/2006 |
| NL | 7 702 830 | 9/1977 |

(Continued)

OTHER PUBLICATIONS

Borschke, A. J., "Review of Technologies Relating to Menthol Use in Cigarettes", *Rec. Adv. Tob. Sci.*, 1993, pp. 47-70, No. 19.

(Continued)

*Primary Examiner* — Joseph C Rodriguez
*Assistant Examiner* — Kalyanavenkateshware Kumar
(74) *Attorney, Agent, or Firm* — Womble Carlyle Sandridge & Rice, LLP

(57) ABSTRACT

An apparatus and associated method are provided for sorting objects as having one of an accepted and rejected status. The apparatus includes a hopper assembly configured to receive a plurality of objects and to release the objects through a release port associated therewith. A first object sorting arrangement is in communication with the hopper assembly and is configured to receive the objects therefrom. The first object sorting arrangement includes a first inclined member in communication with the hopper assembly for directing the objects to a first deflector member spaced-apart from the first inclined member. Objects deflected over a first wall member spaced-apart from the first deflector member, the first deflector member being disposed between the first inclined member and the first wall member have an accepted status, while objects directed into a first channel disposed between the first deflector member and the first wall member have a rejected status.

30 Claims, 14 Drawing Sheets

(56) References Cited

U.S. PATENT DOCUMENTS

| | | | | |
|---|---|---|---|---|
| 3,685,521 | A | | 8/1972 | Dock |
| 3,916,914 | A | | 11/1975 | Brooks et al. |
| 3,972,335 | A | | 8/1976 | Tiggelbeck et al. |
| 3,991,773 | A | | 11/1976 | Walker |
| 4,082,098 | A | | 4/1978 | Owens, Jr. |
| 4,141,450 | A | | 2/1979 | Clin et al. |
| 4,281,671 | A | | 8/1981 | Bynre et al. |
| 4,513,756 | A | | 4/1985 | Pittman et al. |
| 4,528,993 | A | | 7/1985 | Sensabaugh, Jr. et al. |
| 4,624,269 | A | | 11/1986 | Story et al. |
| 4,729,391 | A | | 3/1988 | Woods et al. |
| 4,862,905 | A | | 9/1989 | Green, Jr. et al. |
| 4,865,056 | A | | 9/1989 | Tamaoki et al. |
| 4,889,144 | A | | 12/1989 | Tateno et al. |
| 4,941,486 | A | | 7/1990 | Dube et al. |
| 4,987,907 | A | | 1/1991 | Townend |
| 5,012,829 | A | | 5/1991 | Thesing et al. |
| 5,092,352 | A | | 3/1992 | Sprinkle, III et al. |
| 5,112,474 | A | * | 5/1992 | Douglas ..... 209/240 |
| D335,934 | S | | 5/1993 | Howard |
| 5,331,981 | A | | 7/1994 | Tamaoki et al. |
| 5,387,416 | A | | 2/1995 | White et al. |
| 6,044,796 | A | * | 4/2000 | Ireland ..... 119/52.2 |
| 6,584,979 | B2 | | 7/2003 | Xue et al. |
| 6,631,722 | B2 | | 10/2003 | MacAdam et al. |
| 6,761,174 | B2 | | 7/2004 | Jupe et al. |
| 7,115,085 | B2 | | 10/2006 | Deal |
| 7,479,098 | B2 | | 1/2009 | Thomas et al. |
| 7,578,298 | B2 | | 8/2009 | Karles et al. |
| 7,793,665 | B2 | | 9/2010 | Dube et al. |
| 2004/0261807 | A1 | | 12/2004 | Dube et al. |
| 2005/0244521 | A1 | | 11/2005 | Strickland et al. |
| 2006/0112964 | A1 | | 6/2006 | Jupe et al. |
| 2006/0130861 | A1 | | 6/2006 | Luan et al. |
| 2006/0144412 | A1 | | 7/2006 | Mishra et al. |
| 2006/0162732 | A1 | | 7/2006 | Winn et al. |
| 2006/0180522 | A1 | | 8/2006 | Legtenberg |
| 2006/0191548 | A1 | | 8/2006 | Strickland et al. |
| 2007/0012327 | A1 | | 1/2007 | Karles et al. |
| 2007/0062549 | A1 | | 3/2007 | Holton, Jr. et al. |
| 2007/0095357 | A1 | | 5/2007 | Besso et al. |
| 2007/0186941 | A1 | | 8/2007 | Holton, Jr. et al. |
| 2007/0261707 | A1 | | 11/2007 | Wintersn et al. |
| 2008/0029110 | A1 | | 2/2008 | Dube et al. |
| 2008/0166395 | A1 | | 7/2008 | Roush |
| 2008/0302373 | A1 | | 12/2008 | Stokes et al. |

FOREIGN PATENT DOCUMENTS

| | | |
|---|---|---|
| WO | WO 03/009711 | 2/2003 |
| WO | WO 2004/095959 | 11/2004 |
| WO | WO 2005/041699 | 5/2005 |
| WO | WO 2005/063060 | 7/2005 |
| WO | WO 2006/004480 | 1/2006 |
| WO | WO 2006/136197 | 12/2006 |
| WO | WO 2006/136199 | 12/2006 |
| WO | WO 2007/010407 | 1/2007 |
| WO | WO 2007/060543 | 5/2007 |
| WO | WO 2007/138484 | 12/2007 |

OTHER PUBLICATIONS

International Search Report and Written Opinion of the International Searching Authority for corresponding International Application No. PCT/US2011/047276.

* cited by examiner

APPARATUS FOR SORTING OBJECTS, AND ASSOCIATED METHOD

BACKGROUND OF THE DISCLOSURE

1. Field of the Disclosure

The present disclosure relates to sorting apparatuses and, more particularly, to an apparatus for sorting objects, such as capsules, as having an accepted or rejected quality or status, and an associated method.

2. Description of Related Art

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R.J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. U.S. Pat. No. 6,761,174 to Jupe et al. proposes the placement of adsorbent and flavor-releasing materials in a cigarette filter. U.S. Pat. No. 6,584,979 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,729,391 to Woods et al.; and U.S. Pat. No. 5,012,829 to Thesing et al.

In some instances, cigarettes include a hollow object positioned in their filter element, and the contents of that object is released into the filter element upon rupture of the object in the attempt to alter the nature or character of the mainstream smoke passing through the filter element. See, for example, U.S. Pat. No. 3,339,558 to Waterbury; U.S. Pat. No. 3,366,121 to Carty; U.S. Pat. No. 3,390,686 to Irby, Jr. et al.; U.S. Pat. No. 3,428,049 to Leake; U.S. Pat. No. 3,547,130 to Harlow et al; U.S. Pat. No. 3,575,1809 to Carty; U.S. Pat. No. 3,602,231 to Dock; U.S. Pat. No. 3,625,228 to Dock; U.S. Pat. No. 3,635,226 to Horsewell et al.; U.S. Pat. No. 3,685,521 to Dock; U.S. Pat. No. 3,916,914 to Brooks et al.; U.S. Pat. No. 3,991,773 to Walker; U.S. Pat. No. 4,889,144 to Tateno et al.; U.S. Pat. No. 7,115,085 to Deal; and U.S. Pat. No. 7,578,298 to Karles et al.; US Pat. Application Pub. Nos. 2004/0261807 to Dube et al; US Pat. Application Pub. Nos. 2007/0095357 to Besso et al.; 2007/0012327 to Karles et al.; 2006/0144412 to Mishra et al.; and 2006/0112964 to Jupe et al.; and PCT WO 03/009711 to Kim and WO 2007/060543 to Besso et al. Some cigarettes may also have a capsule positioned in the filter element, and the contents of that capsule reportedly released into the filter element upon rupture of the capsule in order to deodorize the filter element after the cigarette is extinguished. See, for example, U.S. Pat. No. 6,631,722 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. No. 4,865,056 to Tamaoki et al. and U.S. Pat. No. 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

Some smokers might desire a cigarette that is capable of providing, in some instances, selectively, a variety of different flavors, depending upon the smoker's immediate desire. The flavor of such a cigarette might be selected based on the smoker's desire for a particular flavor at that time, or a desire to change flavors during the smoking experience. For example, changing flavors during the smoking experience may enable a smoker to end the cigarette with a breath freshening flavor, such as menthol or spearmint. Some smokers might also desire a cigarette that is capable of releasing a deodorizing agent upon completion of a smoking experience. Such agents may be used to ensure that the remaining portion of a smoked cigarette yields a pleasant aroma after the smoker has finished smoking that cigarette. Some smokers might desire a cigarette that is capable of moistening, cooling, or otherwise modifying the nature or character of the mainstream smoke generated by that cigarette. In this regard, objects may be incorporated within the filter so as to provide such features.

Types of objects, beads, capsules and capsule components that can be employed for the production of filter rods using the foregoing filter rod manufacturing techniques and equipment are of the type set forth in U.S. Pat. No. 3,685,521 to Dock; U.S. Pat. No. 3,916,914 to Brooks et al.; and U.S. Pat. No. 4,889,144 to Tateno et al.; US Pat. Appl. Pub. No. 2003/0098033 to MacAdam et al.; and 2004/0261807 to Dube et al.; and PCT Application Pub. No. WO 03/009711 to Kim; which are incorporated herein by reference. Tobacco products can incorporate those types of components set forth in US Patent Publication Nos. 2006/0272663 to Dube et al., 2006/01330961 to Luan et al., 2006/0144412 to Mishra et al.; 2007/0012327 to Karles et al.; 2007/0068540 to Thomas et al.; and 2008/0029110 to Dube et al.; PCT WO 2006/136197; PCT WO 2006/136199; PCT WO 2007/010407 PCT WO 2007/060543 and U.S. Pat. No. 7,115,085 to Deal; and U.S. patent application Ser. No. 11/760,983 to Stokes et al. and Ser. No. 12/775,892 to Carpenter et al., as well as within filtered cigarettes that have been marketed under the tradenames "Camel Lights with Menthol Boost" and "Camel Crush" by R. J. Reynolds Tobacco Company. Exemplary pelletized carrier materials and flavor packages are of the type employed in cigarettes that have been marketed commercially in the USA. For example, flavor-carrying pellets have been incorporated into cigarette filters employed on Camel brand cigarettes under the tradenames Mandalay Lime, Mandarin Mint, Breach Breezer, Back Ally Blend, Snakeyes Scotch, Izmir Stinger, Kauai Kolada, Midnight Madness, Aegean Spice, Screwdriver Slots, Twist, Twista Lime, Dark Mint and Blackjack Gin; Kool brand cigarettes under the tradenames Flow and Groove; and Salem brand cigarettes under the tradename Deep Freeze; all of which have been marketed by R. J. Reynolds Tobacco Company.

Further, tobacco may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; U.S. Pat. No. 5,387,416 to White et al.; and Des. 335,934 to Howard; U.S. Pat. Pub. No. 2005/0244521 to Strickland et al. and 2006/0162732 to Winn et al.; U.S. Pat. Pub. Nos. 2006/0191548 to Strickland et al., 2007/0261707 to Winterson et al.; 2007/0062549 to Holton, Jr. et al.; 2007/0186941 to Holton, Jr. et al.; 2008/0166395 to Roush; and PCT Pub. Nos. WO 04/095959 to Arnarp et al.; WO 05/063060 to Atchley et al.; WO 06/004480 to Engstrom; WO 05/041699 to Quinter et al.; and WO 07/138,484 to Wrenn et al.; each of which is incorporated herein by reference. One type of smokeless tobacco product is referred to as "snuff." Snuff typically is formulated in "moist" or "dry" forms.

Representative smokeless tobacco products have been marketed under the trade names Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; and Levi Garrett, Peachy, Taylor's Pride, Kodiak, Hawken Wintergreen, Grizzly, Dental, Kentucky King, Mammoth Cave by Conwood Sales Co., L.P., Interval by Brown & Williamson Tobacco Corp., and Ariva and Stonewall by Star Scientific, Inc.

Representative types of snuff products, commonly referred to as "snus," are manufactured in Europe, particularly in Sweden, by or through companies such as Swedish Match A B, Fiedler & Lundgren A B, Gustavus A B, Skandinavisk Tobakskompagni A/S and Rocker Production AB. Snus products available in the U.S.A. are marketed under the trade names Camel Snus Frost, Camel Snus Original and Camel Snus Spice by R. J. Reynolds Tobacco Company.

Snus products, such as Camel Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products do not require expectoration by the user.

Again, some users might desire a smokeless tobacco product that is capable of providing, in some instances, selectively, a variety of different flavors, depending upon the user's immediate desire. The flavor of such a smokeless tobacco product might be selected based on the user's desire for a particular flavor at that time, or a desire to change flavors during use. For example, changing flavors during use may enable a user to end the experience with a breath freshening flavor, such as menthol or spearmint. Accordingly, it may be desirable to provide a smokeless tobacco product that is capable of providing distinctive, different pleasurable sensory experiences, for a user. Some users might also desire a smokeless tobacco product that is capable of modifying the nature or character of the by-product generated by that smokeless tobacco product. In this regard, sensory-modifying objects may be incorporated within the smokeless tobacco product so as to provide such features.

However, the quality of a sensory-modifying object incorporated within a filter element or smokeless tobacco product may affect the manufacturing process and/or the user's experience. For example, objects that are misshapen may not efficiently flow through or be processed by a manufacturing system, thereby slowing or halting the manufacturing process for the end product. In some instances, such objects may be intended to include a liquid payload contained therein. However, in a batch of such objects, some of those objects may be of unacceptable quality for manufacturing and/or the end product, or may be otherwise defective and, in such instances, may thus undesirably affect the manufacturing process and/or the end products produced thereby if allowed into the process. For example, partially or entirely empty objects (i.e., those objects without the specified liquid payload) and/or deformed objects may negatively affect and interfere with the efficiency of the manufacturing process, for example, by interacting in a non-optimum manner with the object delivery provisions or by producing a defective end product. Further, end products incorporating such non-standard objects may negatively affect the user's experience with the cigarette or smokeless tobacco product.

As such, it would be desirable to provide an apparatus and associated method capable of batch sorting such objects into two categories: those having an acceptable quality or status and those having a rejected quality or status (i.e., unsuitable for a manufacturing process and/or unsuitable for incorporation into an end product). Further, such an apparatus and method should desirably be able to efficiently, consistently, and timely evaluate/sort such objects into the respective category. In some instances, the apparatus and method may provide redundant measures to more efficiently separate such objects into the acceptable and rejected categories by reducing the amount of such objects being designated with a rejected status.

BRIEF SUMMARY OF THE DISCLOSURE

The above and other needs are met by the present disclosure which, according to one aspect, provides an apparatus for sorting objects as having one of an accepted and rejected status. The apparatus includes a hopper assembly adapted to receive a plurality of objects and to release the objects through a release port associated therewith. The apparatus further includes a first object sorting arrangement in communication with the hopper assembly and configured to receive the objects therefrom. The first object sorting arrangement includes a first inclined member having a first end in communication with the hopper assembly at a first elevation, and an opposing second end at a second elevation less than the first elevation. The first end is arranged to receive the objects exiting the release port of the hopper assembly and to direct the objects toward the second end. The first object sorting arrangement further includes a first deflector member spaced-apart from the second end of the first inclined member and disposed at a third elevation less than the second elevation. The first deflector member is arranged to deflect the objects directed thereto from the second end of the first inclined member. The first object sorting arrangement further includes a first wall member spaced-apart from the first deflector member, such that the first deflector member is disposed between the first inclined member and the first wall member, the first wall member extending to a fourth elevation greater than the third elevation. The first object sorting arrangement further includes a first channel disposed between the first deflector member and the first wall member. The first channel is configured to receive a first portion of the objects not deflected over the first wall member by the first deflector member, wherein the first portion of the objects received by the first channel have a rejected status, and a second portion of the objects deflected over the first wall member by the first deflector member have an accepted status.

Another aspect of the present disclosure provides a method for sorting objects as having one of an accepted and rejected status. Such a method comprises directing a plurality of objects from a hopper assembly through a release port associated therewith onto a first end of a first inclined member of a first object sorting arrangement, the first end being disposed at a first elevation. The objects are then directed toward a second end of the first inclined member, the second end opposing the first end and being disposed at a second elevation less than the first elevation, to a first deflector member spaced-apart from the second end of the first inclined member and disposed at a third elevation less than the second elevation. The first deflector member is arranged to deflect the objects directed thereto from the second end of the first inclined member, wherein a second portion of the objects deflected by the first deflector member over a first wall member, the first wall member being spaced-apart from the first deflector member such that the first deflector member is disposed between the first inclined member and the first wall member and extends to a fourth elevation greater than the third elevation, have an accepted status, and wherein a first portion of the objects not deflected over the first wall member by the first deflector member are received by a first channel disposed between the first deflector member and the first wall member and have a rejected status.

Aspects of the present disclosure thus provide advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

The present disclosure now will be described more fully hereinafter with reference to the accompanying drawings, in which some, but not all aspects of the disclosure are shown. Indeed, this disclosure may be embodied in many different forms and should not be construed as limited to the aspects set forth herein; rather, these aspects are provided so that this disclosure will satisfy applicable legal requirements. Like numbers refer to like elements throughout.

Aspects of the present disclosure provide an apparatus and associated method for sorting objects as having one of an accepted and rejected status. Such objects may be capable of incorporation into, for example, cigarette products or smokeless tobacco products (not shown), as described previously. Aspects of the present disclosure, however, may be used for sorting other objects, and the disclosure provided herein is thus not limited to sorting objects for use in cigarette and smokeless tobacco products.

Figure 1:
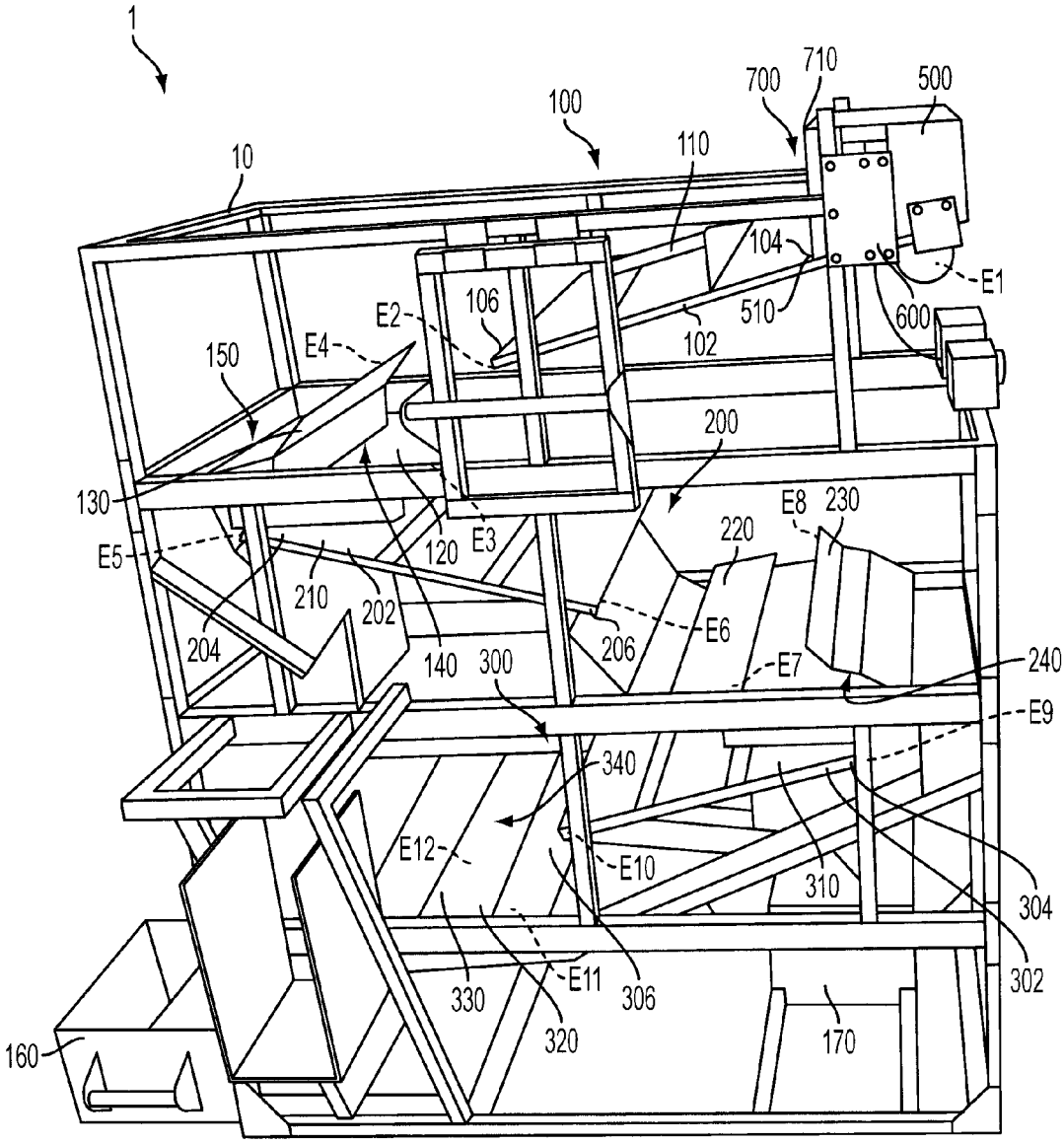
FIG. 1 is a perspective view of an apparatus for sorting objects, according to one aspect of the present disclosure.
Figure 2:
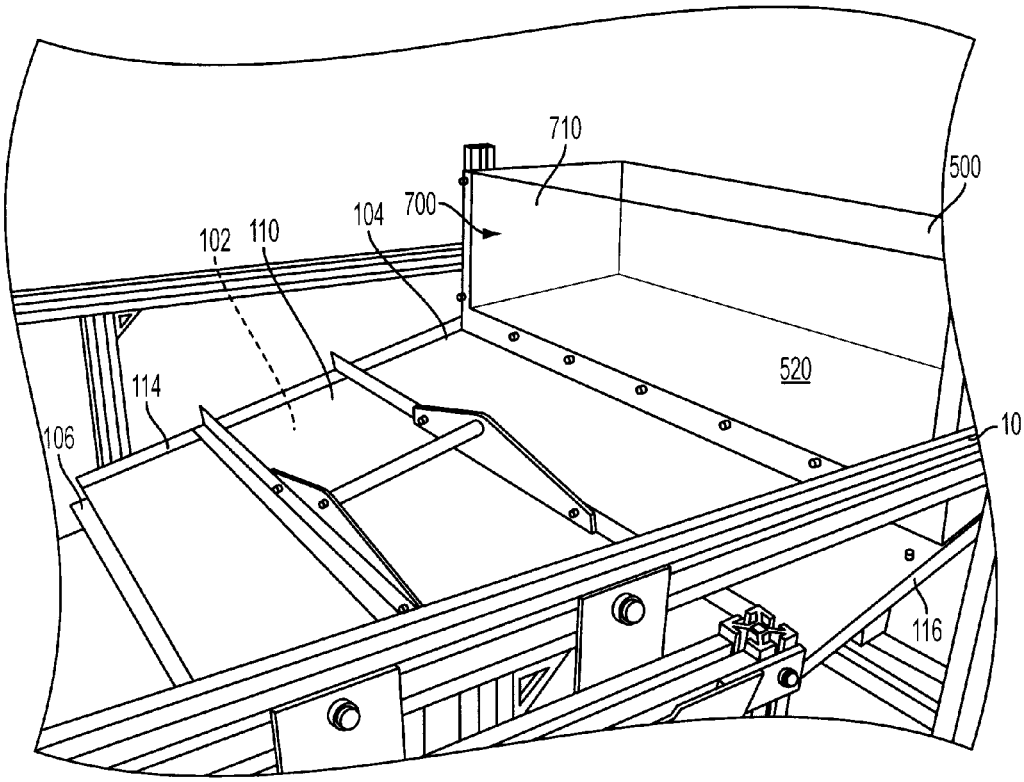
FIG. 2 is a perspective sectional view of the apparatus in FIG. 1, illustrating a first object sorting arrangement in communication with a hopper assembly.
Figure 3:
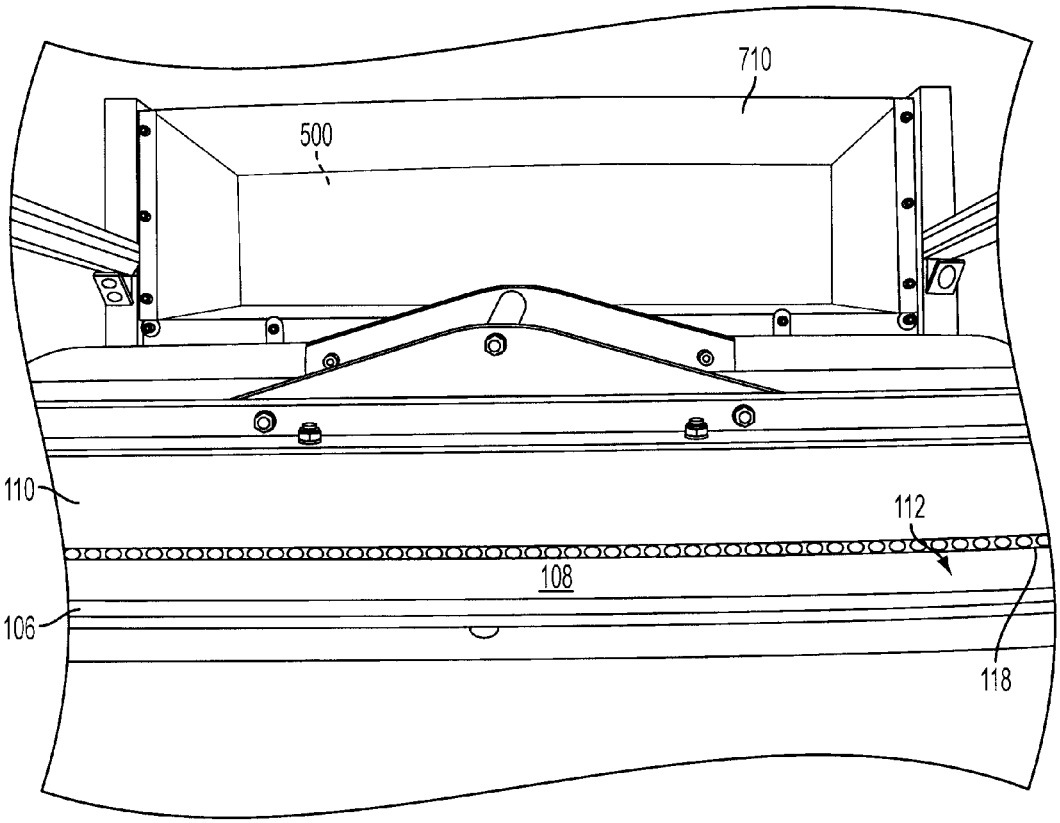
FIG. 3 is a perspective sectional view of the apparatus in FIG. 1, illustrating the hopper assembly in communication with a first inclined member.
Figure 4:
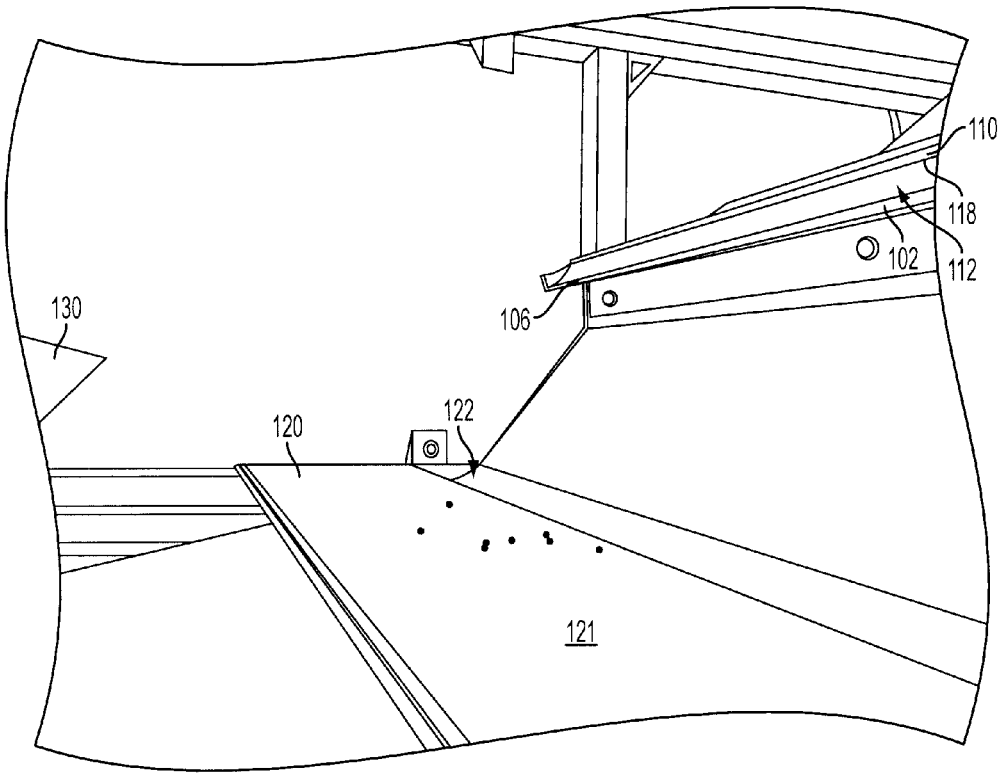
FIG. 4 is a perspective sectional view of the apparatus in FIG. 1, illustrating a first deflector member arranged to receive objects from a first inclined member.
Figure 5:
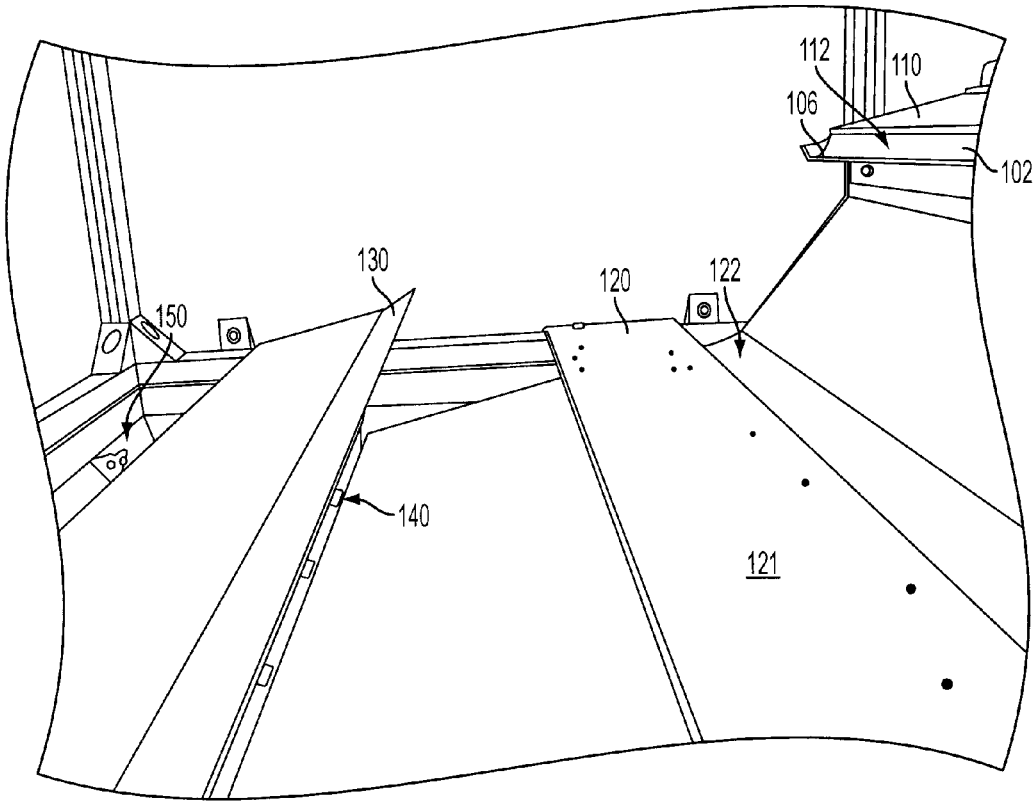
FIG. 5 is a perspective sectional view of the apparatus in FIG. 1, illustrating the arrangement of a first deflector member and a first wall member spaced-apart therefrom.
Figure 6:
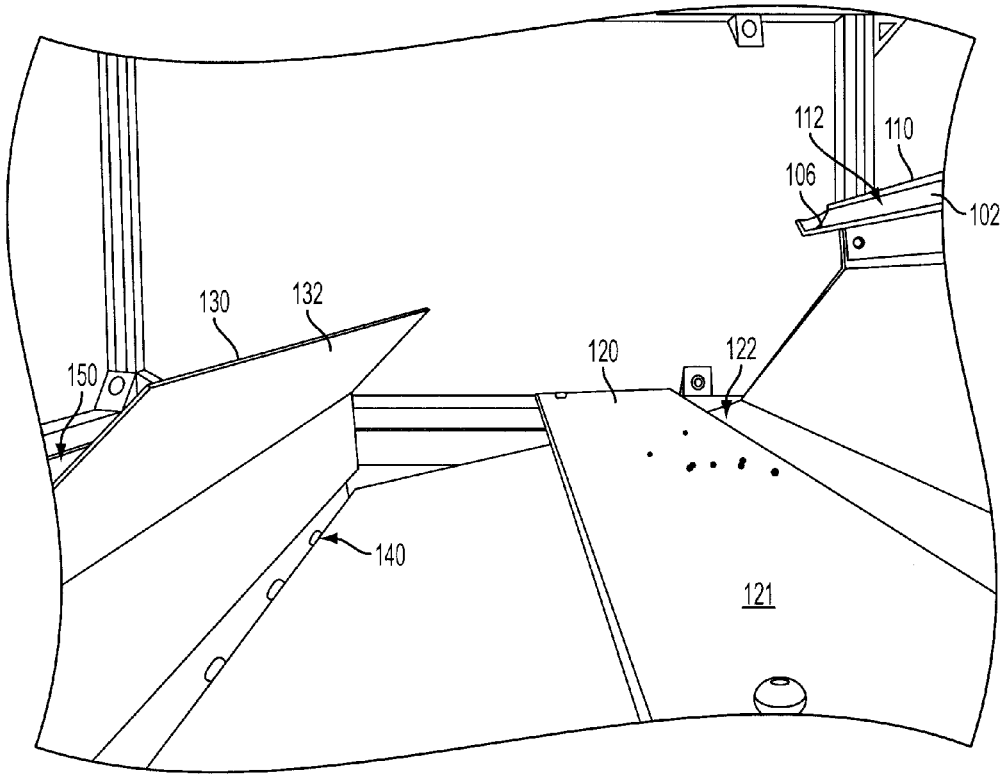
FIG. 6 is another perspective sectional view of the apparatus in FIG. 1, illustrating the arrangement of the first deflector member and the first wall member spaced-apart therefrom.
Figure 7:
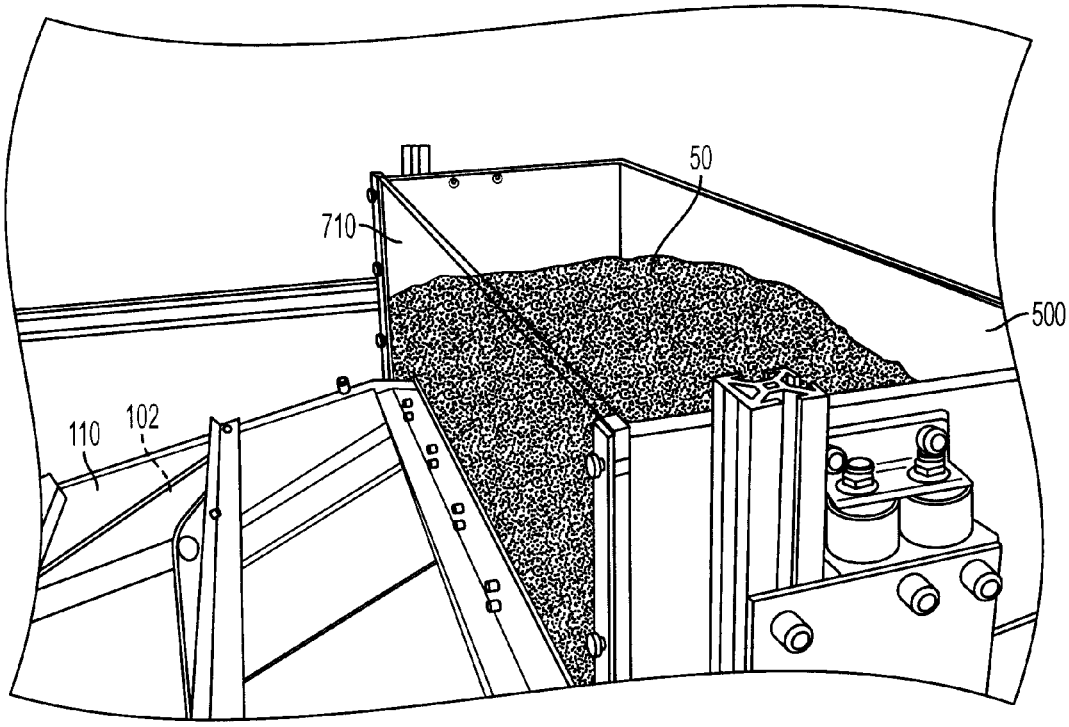
FIG. 7 is a perspective sectional view of the apparatus in FIG. 1, illustrating the hopper assembly having a plurality of objects received therein.
Figure 8:
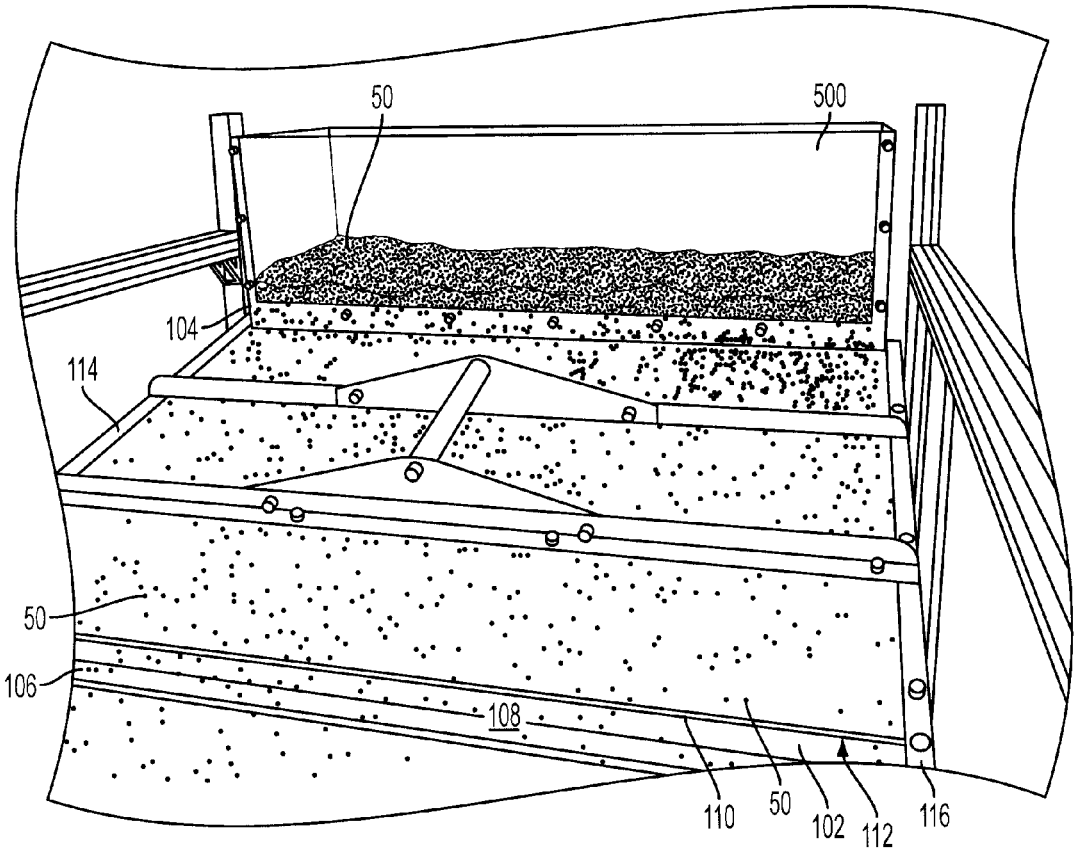
FIG. 8 is a perspective sectional view of the apparatus in FIG. 1, illustrating objects exiting the hopper assembly and moving along a first inclined member.
Figure 9:
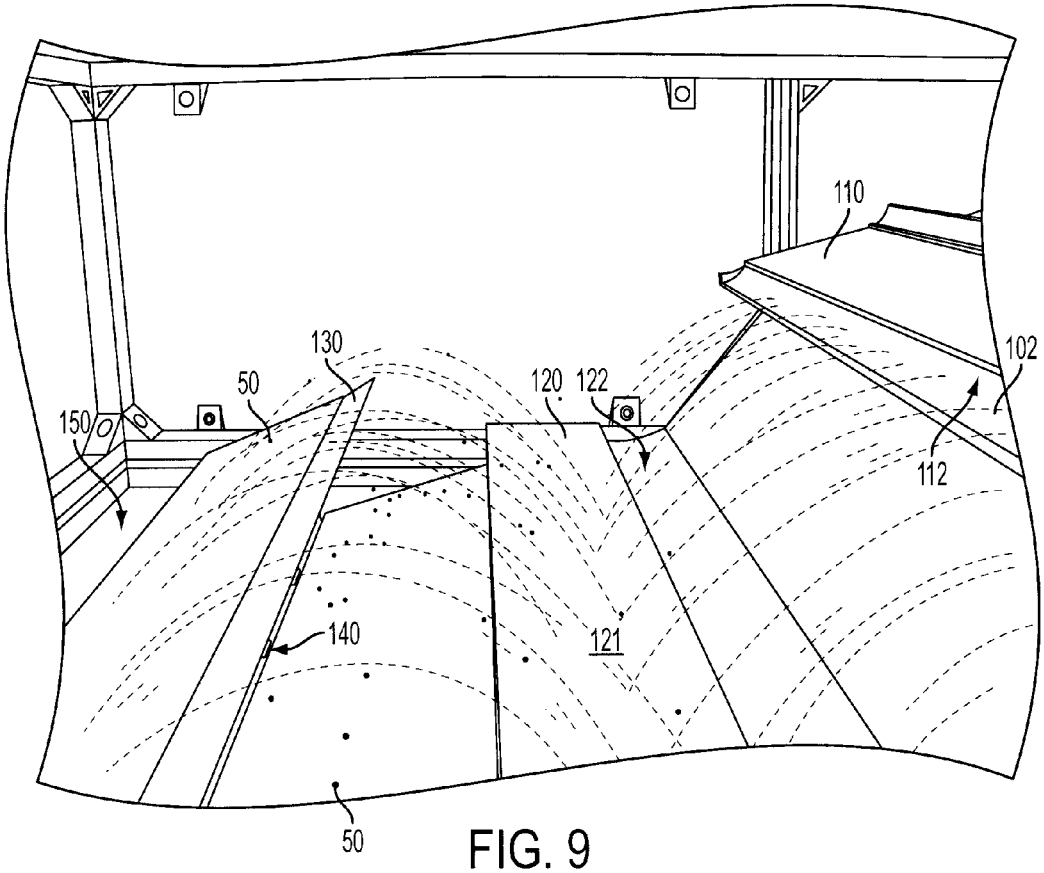
FIG. 9 is a perspective sectional view of the apparatus in FIG. 1, illustrating objects falling from a first inclined member and deflecting from a first deflector member toward a first wall member.
Figure 10:
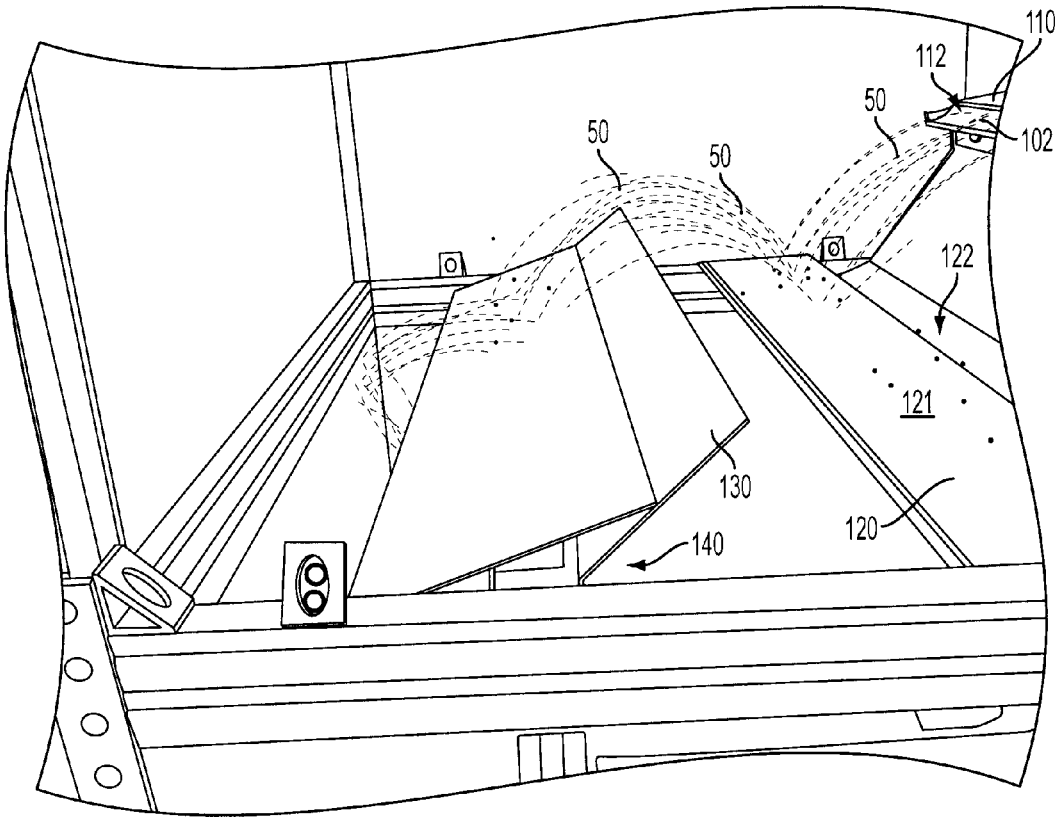
FIG. 10 is a perspective sectional view of the apparatus in FIG. 1, illustrating some objects clearing a first wall member and other objects not clearing the first wall member after being deflected from a first inclined member.

FIG. 1 illustrates an apparatus 1 for sorting objects 50 as having one of an accepted and rejected status (i.e., pass/fail). The apparatus 1 may generally include a frame 10 for arranging various components of the apparatus 1 in a structured manner As shown in FIGS. 1-3, 7 and 8, such an apparatus 1 may include a hopper assembly 500 configured to receive a plurality of objects 50 and to release the objects 50 through a release port 510 associated therewith. The apparatus 1 may also include an agitation device 600 engaged with the hopper assembly 500 and configured to agitate the objects 50 received therein so as to facilitate dispensation of the objects 50 through the release port 510. The apparatus may also include a retention member 700 engaged with the release port 510 of the hopper assembly 500. The retention member 700 may be selectively actuatable to dispense the objects 50 through the release port 510. In this regard, the retention member 700 may include a wall member 710 capable of moving perpendicularly with respect to a bottom wall 520 of the hopper assembly 500 so as to release the objects 50 from the hopper assembly 500.

Upon exiting the hopper assembly 500 via the release port 510, the objects 50 may be directed to a first object sorting arrangement 100 in communication with the hopper assembly 500 and configured to receive the objects 50 therefrom. The first object sorting arrangement 100 may be configured to separate the objects 50 as having one of an accepted status and a rejected status, according to the ability of each individual object 50 to navigate the structure of the first object sorting arrangement 100. Such ability to navigate the structure may be affected, for example, by the shape (or misshape) of the object 50, the condition of the payload carried by the object 50 (e.g., the amount of liquid contained within the object 50), or some other physical parameter demonstrated by the object 50.

According to one aspect, the first object sorting arrangement 100 may include a first inclined member 102 in communication with the hopper assembly 500 via the release port 510. The first inclined member 102 may be inclined with respect to the hopper assembly 500. In this regard, the first inclined member 102 may include first and second ends 104, 106, wherein the first end 104 may be disposed at a first elevation E1 proximate to the bottom wall 520/release port 510 of the hopper assembly 500. The second end 106 may be disposed at a second elevation E2 lower or otherwise less than the first elevation E1. As such, the objects 50 exiting the hopper assembly 500 are directed downward onto the first inclined member 102 and along a lateral surface 108 of the first inclined member 102 (i.e., under the influence of gravity), from the first end 104 to the second end 106. In this regard, the objects 50 may, for instance, gain momentum by traveling along the first inclined member 102 toward the second end 106. In one exemplary aspect, the first inclined member 102 may have a length of about 19 inches and an incline angle of about 14-14.5°, though these parameters are not limiting with respect to a suitable configuration of the first inclined member 102.

In some instances, a cover member 110 may be provided to oppose the first inclined member 102 in a spaced-apart manner so as to form and define a channel 112 therebetween for containing, within the channel 112, the objects 50 directed along the first inclined member 102. In this regard, the first inclined member 102 may include a pair of side walls 114, 116 upon which a lateral surface 118 of the cover member 110 may rest so as to space-apart the lateral surface 108 of the first inclined member 102 from the cover member 110. In other instances, the cover member 110 may include a pair of side walls on either side thereof so as to form the channel 112. Still in other instances, the cover member 110 may be integrally formed with the first inclined member 102 as a single workpiece. The channel 112 is open-ended at the first and second ends 104, 106 of the first inclined member 102.

According to one aspect, the channel 112 may provide about an 8 mm gap between the lateral surface 108 of the first inclined member 102 and the lateral surface 118 of the cover member 110. The cover member 110 may serve to limit or reduce skipping of the objects 50 or deflection of the objects 50 by the first inclined member 102 as the objects 50 move downward along the first inclined member 102. That is, without the cover member 110, misshapen or otherwise defective (i.e., likely having a rejected status) objects 50 may skip along the lateral surface 108 in such a manner that allows the defective object 50 to gain sufficient momentum to successfully navigate the structure. As such, the cover member 110 is configured to promote a laminar or otherwise single layer flow of the objects 50 along the first inclined member 102, regardless of whether the object 50 has one of an accepted or rejected quality or status. In this manner, the objects 50 substantially remain in contact with the lateral surface 108 of the first inclined member 102 while moving toward the second end 106 thereof. Furthermore, by limiting the deflection of the objects 50, the cover member 110 also limits the interaction of the would-be skipping objects 50 with other objects 50, which might affect the ability of an object 50 to gain sufficient momentum to traverse the structure. Otherwise stated, the hopper assembly 500 and the first inclined member 102 are configured to cooperate to provide a defect-free object 50 with sufficient momentum and/or other motion characteristics to successfully traverse the first object sorting arrangement 100, while removing those objects 50 not meeting that standard as being defective or non-standard.

As shown in FIGS. 4-6, 9 and 10, at the second end 106 of the first inclined member 102, the objects 50 leave the first inclined member 102 and fall therefrom in a gravity-influenced free-fall (i.e., no contact with any component of the apparatus 1), toward a first deflector member 120 spaced-apart from the second end 106 and disposed at a third elevation E3 below or lesser than the second elevation E2. That is, the first inclined member 102 may have the lateral surface 108 configured to impart at least some lateral motion to the objects 50 as the objects 50 fall from the second end 106 thereof toward the first deflector member 120. In this regard, the first deflector member 120 may be laterally and vertically spaced-apart from the second end 106 (i.e., to match the trajectory of and receive the objects 50 falling from the second end 106 such that the objects 50 strike and are deflected by the first deflector member 120). In one exemplary aspect, the difference between the second elevation E2 and the third elevation E3 may be about 6 inches, though this may vary considerably. The first deflector member 120 is arranged to deflect the objects 50 directed thereto from the second end 106 of the first inclined member 102 in a lateral direction away from the first inclined member 102. In this manner, the objects 50 may be directed toward the first deflector member 120 in such a manner that facilitates a bouncing action or deflection of the objects 50 due to interaction a the lateral surface 121 of the first deflector member 120. The first deflector member 120 may be comprised of any suitable material such as, for example, metal, polymer (e.g., plexiglass), or composite materials. According to some aspects, the first deflector member 120 may be inclined such that objects 50 do not become stationary thereon. That is, the first deflector member 120 may be slanted such that objects 50 move towards a recovery provision 122 in the event that an object 50 is tending to become stationarily disposed on the first deflector member 120 due to, for example, interference or interaction with other objects 50. In other instances, the first deflector member 120 may be slanted in the opposite direction for similar reasons, or may be horizontally-disposed. In an exemplary aspect, the first deflector member 120 may be angled at 3.2° such that objects 50 do not remain on the first deflector member 120, but instead move toward the recovery provision 122.

In one aspect, the interaction of each object 50 with the first deflector member 120 determines whether an object 50 has an accepted or rejected status. In this regard, objects 50 clearing a first wall member 130 after being deflected by the first deflector member 120 are designated to have an accepted status, while objects not clearing the first wall member 130 are designated to have a rejected status. As mentioned previously, object defects (e.g., misshapen objects, empty objects, incorrectly filled objects etc.) affect the ability of the objects 50 to clear the first wall member 130 after being deflected by the first deflector member 120 (i.e., such that each deflected object has both a horizontal (lateral) and vertical component in the deflected trajectory) These same object defects may undesirably affect the manufacturing process and/or the user's experience, and, as such, objects having such defects are designated with the rejected status as being unsuitable for incorporation in an end product.

The first wall member 130 may thus be spaced-apart from the first deflector member 120, both laterally and vertically, such that the first deflector member 120 is disposed between the first inclined member 102 and the first wall member 130. The first deflector member 120 may be configured to deflect the objects 50 with at least a portion of the lateral motion imparted thereto by the first inclined member 102 and, in one aspect, the first wall member 130 extends to a fourth elevation E4 greater than the third elevation E3. According to one exemplary aspect, the difference between the second elevation E2 of the second end 106 and the fourth elevation E4 may be about 2-3 inches, and the lateral distance between the second end 106 and the first wall member 130 may be about 11.5 inches, though these dimensions are for exemplary purposes only and are not intended to be limiting.

In some instances, the first wall member 130 may be angled or otherwise non-perpendicularly oriented with respect to the first deflector member 120. In this manner, some objects 50 not clearing the first wall member 130 and, instead, interacting with a forward portion 132 thereof may be immediately deflected downward. In this regard, the objects 50 interacting with the forward portion 132 may be prevented from deflecting rearward in a substantially horizontal manner, wherein such objects 50 would potentially interfere with other objects 50 attempting to overcome the first wall member 130. Furthermore, angling or inclining the first wall member 130 may prevent objects 50 that interact with the forward portion 132 from proceeding over the first wall member 130 due to sufficient momentum for carrying the object over the first wall member 130, even in the course of contacting the first wall member 130. In an exemplary aspect, the first wall member 130 may be angled at about 45° toward the first deflector member 120, though this inclination may vary considerably.

Figure 14:
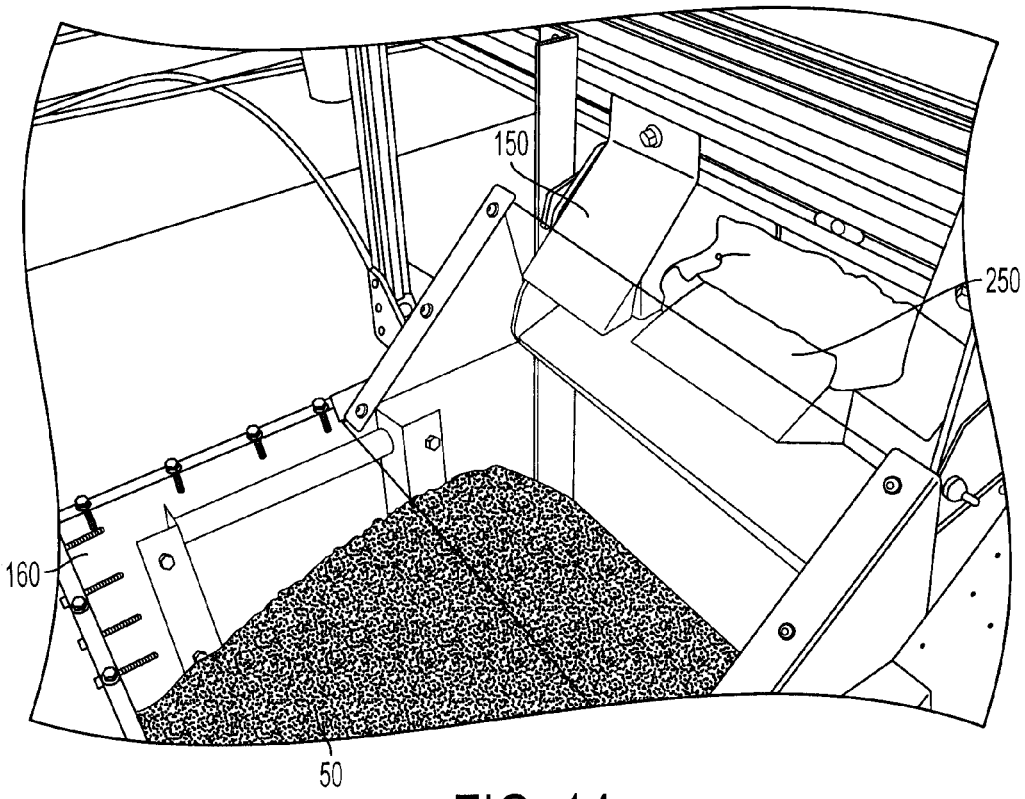
FIG. 14 is a perspective sectional view of the apparatus in FIG. 1, illustrating an accepted object receptacle in communication with each of a first, second and third object sorting arrangement.

A first channel 140 may be disposed between the first deflector member 120 and the first wall member 130. The first channel 140 may be configured to receive a first portion of the objects 50 not deflected over the first wall member 130 by the first deflector member 120, wherein the first portion of the objects 50 received by the first channel 140 are designated to have a rejected status. A second portion of the objects 50 deflected over the first wall member 130 by the first deflector member 120 are designated to have an accepted status. Additionally, the objects 50 entering the recovery zone 122 may be directed to the first channel 140 as having a rejected status. In one instance, the objects 50 entering the recovery zone 122 may be routed underneath the first deflector member 120 to the first channel 140. Objects 50 clearing the first wall member 130 and having an accepted status may be directed to a first chute 150 which routes the objects 50 having the accepted status into an accepted object receptacle 160, as shown in FIG. 14. The objects 50 having accepted status received in the accepted object receptacle 160 may be considered ready for use in the manufacturing process. Objects 50 not deflected over the first wall member 130 enter the first channel 140 which, in some instances, may route the objects 50 having the rejected status into a rejected object receptacle 170 in communication with the first channel 140. Accordingly, objects 50 may be sorted with the first object sorting arrangement 100 as having one of an accepted status and a rejected status.

For various reasons, for example, because objects 50 may interfere with one another during movement through the first object sorting arrangement 100, some objects 50 of acceptable quality (accepted status) may not be deflected over the first wall member 130 upon interaction with the first deflector member 120. As such, those objects 50 may thus be incorrectly characterized as having a rejected status, even though actually being of acceptable quality. As such, in some aspects, the apparatus 1 may include supplemental measures for minimizing or otherwise addressing such incorrect characterization. For example, according to one aspect, a second object sorting arrangement 200 may be provided in conjunction with the first object sorting arrangement 100 to reduce or otherwise minimize the rejection of objects 50 having acceptable quality.

Figure 11:
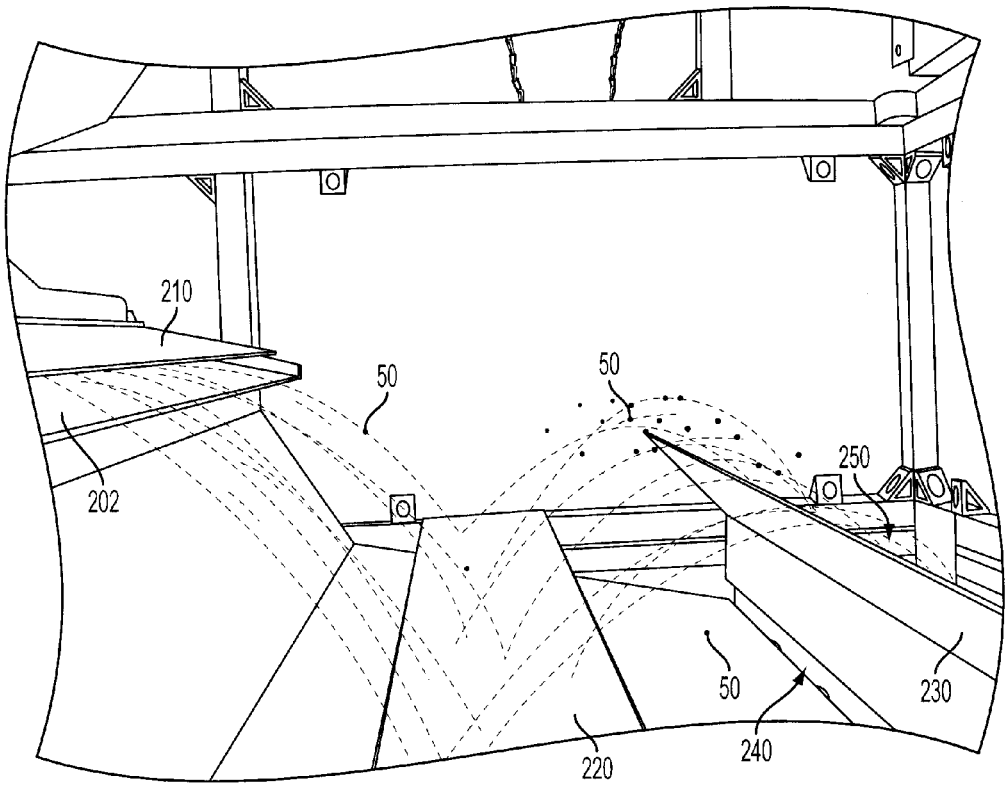
FIG. 11 is a perspective sectional view of the apparatus in FIG. 1, illustrating a second object sorting arrangement in communication with a first channel of the first object sorting arrangement.

In this regard, a first portion of the objects 50 designated as having a rejected status after traversing the first object sorting arrangement 100 may be directed from the first channel 140 to the second object sorting arrangement 200, as shown in FIGS. 1 and 11. The second object sorting arrangement 200 may be structured substantially similar to the first object sorting arrangement 100. In this regard, the second object sorting arrangement 200 may include a second inclined member 202 having a first end 204 in communication with the first channel 140 at a fifth elevation E5 less than the third elevation E3. The second inclined member 202 may have a second end 206 at a sixth elevation E6 less than the fifth elevation E5. The first end 204 may be configured to receive the first portion of the objects 50 exiting the first channel 140 and to direct the first portion toward the second end 206 of the second inclined member 202. The second object sorting arrangement 200 may include a second deflector member 220 spaced-apart from the second end 206 of the second inclined member 202 and disposed at a seventh elevation E7 less than the sixth elevation E6. The second deflector member 220 may be arranged to deflect the first portion of the objects 50 directed thereto from the second end 206 of the second inclined member 202.

The second object sorting arrangement 200 may also include a second wall member 230 spaced-apart from the second deflector member 220, such that the second deflector member 220 is disposed between the second inclined member 202 and the second wall member 230. The second wall member 230 may extend to an eighth elevation E8 greater than the seventh elevation E7. The second object sorting arrangement 200 may include a second channel 240 disposed between the second deflector member 220 and the second wall member 230. The second channel 240 may be configured to receive a first portion of the objects 50 not being deflected over the second wall member 230 by the second deflector member 220. The first portion of the objects 50 received by the second channel 240 would be designated as having a rejected status, and a second portion of the objects 50 deflected over the second wall member 230 by the second deflector member 220 would be designated as having an accepted status. Objects 50 clearing the second wall member 230 and having an accepted status may be routed to the accepted object receptacle 160, as shown in FIG. 14, via a second chute 250. Objects 50 not deflected over the second wall member 230 enter the second channel 240 which, in some instances, may route the objects 50 having the rejected status into the rejected object receptacle 170 in communication with the second channel 240. In one aspect, the second inclined member 202 may be arranged in an inclination opposite to an inclination of the first inclined member 102.

Figure 12:
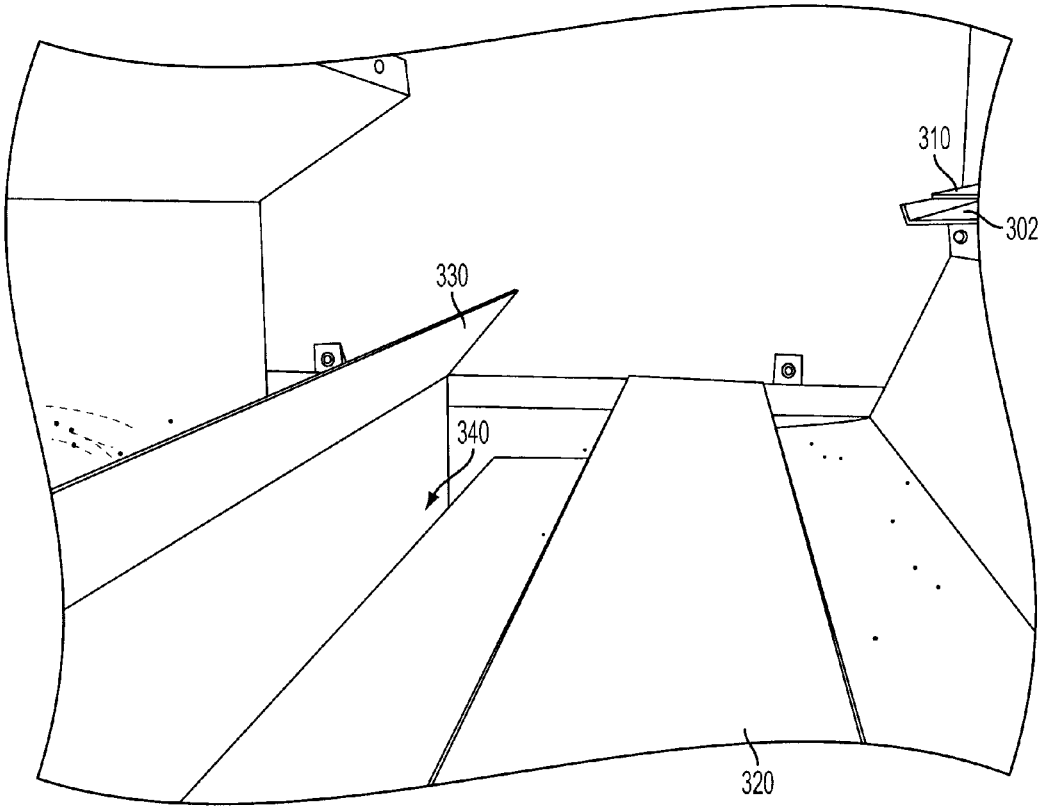
FIG. 12 is a perspective sectional view of the apparatus in FIG. 1, illustrating a third deflector member and third wall member of a third object sorting arrangement.
Figure 13:
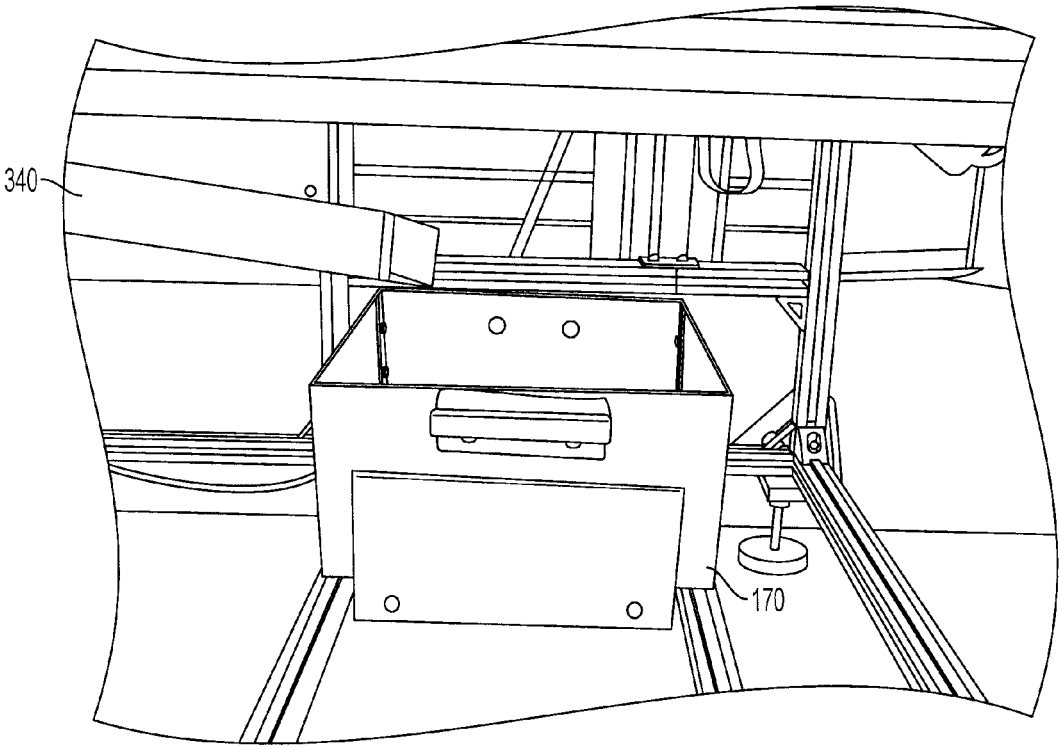
FIG. 13 is a perspective sectional view of the apparatus in FIG. 1, illustrating a rejected object receptacle in communication with a third object sorting arrangement.

According to one particular aspect, a third object sorting arrangement 300 may be provided in conjunction with the first and second object sorting arrangements 100, 200 to further reduce or otherwise minimize the rejection of objects 50 having an acceptable quality. In this regard, a first portion of the objects 50 having a rejected status after traversing the second object sorting arrangement 200 may be directed from the second channel 240 to the third object sorting arrangement 300, as shown in FIGS. 1 and 12. The third object sorting arrangement 300 may be structured substantially similar to the first and/or second object sorting arrangements 100, 200. In this regard, the third object sorting arrangement 300 may include a third inclined member 302 having a first end 304 in communication with the second channel 240 at a ninth elevation E9 less than the seventh elevation E7. The third inclined member 302 may have a second end 306 at a tenth elevation E10 less than the ninth elevation E9. The first end 304 may be configured to receive the first portion of the objects 50 exiting the second channel 240 and to direct the first portion toward the second end 306 of the third inclined member 302. The third object sorting arrangement 300 may include a third deflector member 320 spaced-apart from the second end 306 of the third inclined member 302 and disposed at an eleventh elevation E11 less than the tenth elevation E10. The third deflector member 320 may be arranged to deflect the first portion of the objects 50 directed thereto from the second end 206 of the third inclined member 302.

The third object sorting arrangement 300 may include a third wall member 330 spaced-apart from the third deflector member 320, such that the third deflector member 320 is disposed between the third inclined member 302 and the third wall member 330. The third wall member 330 may extend to a twelfth elevation E12 greater than the eleventh elevation E11. The third object sorting arrangement 300 may include a third channel 340 disposed between the third deflector member 320 and the third wall member 330. The third channel 340 may be configured to receive a first portion of the objects 50 not being deflected over the third wall member 330 by the third deflector member 320. The first portion of the objects 50 received by the third channel 340 would be designated as having a rejected status, and a second portion of the objects 50 deflected over the third wall member 330 by the third deflector member 320 would be designated as having an accepted status. Objects 50 clearing the third wall member 330 and having an accepted status may be routed to the accepted object receptacle 160, as shown in FIG. 14. Objects 50 not deflected over the third wall member 330 enter the third channel 340 which, in some instances, may route the objects 50 having the rejected status into the rejected object receptacle 170 in communication with the third channel 340. In this regard, objects 50 having a rejected status and collected in the rejected object receptacle 170 would not have been deflected over the wall member in multiple (i.e., all three) object sorting arrangements 100, 200, 300, and may be designated as being finally rejected. In one aspect, the third inclined member 302 may be arranged in an inclination opposite to the inclination of the second inclined member 202.

The second and third object sorting arrangements 200, 300 may include any or all other aspects disclosed in relation to the first object sorting arrangement 100. For example, the second and third object sorting arrangements 200, 300 may include respective cover members 210, 310, as shown in FIG. 1, for limiting any skipping or deflection of the objects 50 in the same manner as cover member 110, as well as recovery provisions, etc. Additional sorting arrangements may also be provided to further refine the sorting procedure. That is, depending on the quantity of objects 50 passing through the apparatus 1, the interference among objects 50 may be high and may require more sorting arrangements to minimize the false characterization of an acceptable object 50 as having a rejected status. As such, the number of sorting arrangements provided could be based, for example, upon an acceptable range of error for such mischaracterization. Further, the apparatus 1 disclosed herein requires little or no automation and, as such, may incur only limited operational costs. In addition, the sorting test is administered in a relatively quick and efficient manner. For example, according to one exemplary aspect as shown in FIG. 1, a five kilogram bag of objects 50 may pass through and be sorted by the apparatus 1 in about three minutes.

Aspects of the present disclosure may sort objects 50 such as, for example, those containing a flavorant or flavoring ingredient (as used herein, the terms "flavorant" and "flavoring ingredient" refer to substances, such as liquids or solids, that provide a concentrated release for a sensory effect such as, for example, taste, mouth feel, texture, moistness, coolness/heat, and/or fragrance). The objects 50 may include capsules, pellets, microcapsules or other shaped items designed to deliver a pre-determined, concentrated amount of a flavoring ingredient to the user. For example, representative types of materials and ingredients useful for the manufacture of essentially water insoluble flavored beads or pellets may be found within the filters of cigarettes available as Camel Dark Mint, Camel Mandarin Mint, Camel Spice Crema, Camel Izmir Stinger, Camel Spice Twist, Camel Mandalay Lime and Camel Aegean Spice by R. J. Reynolds Tobacco Company. The object 50 preferably is shaped, sized, and of a texture that provides for comfortable and convenient use.

In some instances, the objects 50 may be synthetically formed structures rather than food-like objects. The object 50 may be hollow with a payload in the hollow portion comprising the flavoring ingredient. The object 50 may be solid with the flavoring ingredient incorporated into the composition forming the solid object and releasable by dissolving or disintegrating the solid object. According to some aspects, the object 50 may be a spherically-shaped hollow capsule carrying a payload comprising a flavoring ingredient.

The size and weight of each object 50 may vary depending upon the desired properties it is to impart to the tobacco product. In some instances, the objects are generally spherical in shape. Exemplary smaller spherical objects may have diameters of at least about 0.5 mm, generally at least about 1 mm, often at least about 2 mm, and frequently at least about 3 mm Exemplary larger spherical objects may have diameters of less than about 6 mm, and often less than about 5 mm. Exemplary smaller individual objects may weigh at least about 5 mg, often at least about 15 mg, and frequently at least about 25 mg. Exemplary larger individual objects may weigh less than about 75 mg, generally less than about 65 mg, and often less than about 55 mg.

An exemplary object 50 may include an outer shell incorporating a material such as gelatin, and an inner payload region incorporating at least one flavoring ingredient and a triglyceride liquid. During use, contact of the object with moisture present in the user's mouth may cause the object to soften, lose its physical integrity, and release the flavoring ingredients within the user's mouth. In other instances, the object may be purposefully crushed by application of pressure to release the flavoring ingredients. Such a release of flavoring ingredient may alter or enhance the flavor of the product, as well as extending the period of time that a user may enjoy the product.

An exemplary object 50 may include an outer shell incorporating a material such as wax, and an inner payload incorporating an aqueous or non-aqueous liquid (e.g., a solution or dispersion of at least one flavoring ingredient within water or an organic liquid such as an alcohol or oil, or a mixture of water and a miscible liquid like alcohol or glycerin). During use of the product, a crushing or other physical destruction of the capsule may allow the capsule to release the moisture contained therein to provide suitable moistening of components of the tobacco formulation. For example, objects 50 having outer shells comprising a food grade waxy substance and an inner payload comprising water may be incorporated within a tobacco product such that, upon rupture of those objects, sufficient water is released to provide a desired moistening effect upon the tobacco formulation. Exemplary types of waxes include ChevronTexaco Refined Waxes 128 and 141 (available from Chevron Corporation) and waxes produced using the wax hydrofining process of ExxonMobil Corporation.

Many modifications and other aspects of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. An apparatus for sorting objects as having one of an accepted and rejected status, the apparatus comprising:

a hopper assembly adapted to receive a plurality of objects and to release the objects through a release port associated therewith; and a first object sorting arrangement in communication with the hopper assembly and configured to receive the objects therefrom, the first object sorting arrangement comprising:

a first inclined member having a first end in communication with the hopper assembly at a first elevation, and an opposing second end at a second elevation less than the first elevation, the first end being arranged to receive the objects exiting the release port of the hopper assembly and to direct the objects toward the second end;

a first deflector member spaced-apart from the second end of the first inclined member and disposed at a third elevation less than the second elevation, the first deflector member being arranged to deflect the objects directed thereto from the second end of the first inclined member;

a first wall member spaced-apart from the first deflector member, such that the first deflector member is laterally disposed between the first inclined member and the first wall member, and such that the first inclined member, the first deflector member, and the first wall member are each laterally spaced-apart from one another, the first wall member extending to a fourth elevation greater than the third elevation; and a first channel disposed between the first deflector member and the first wall member, the first channel being configured to receive a first portion of the objects not deflected over the first wall member by the first deflector member, the first portion of the objects received by the first channel thereby having a rejected status, and a second portion of the objects deflected over the first wall member by the first deflector member thereby having an accepted status.

2. An apparatus according to claim 1 further comprising:

a second object sorting arrangement in communication with the first channel of the first object sorting arrangement, and configured to receive the first portion of the objects therefrom, the second object sorting arrangement comprising:

a second inclined member having a first end in communication with the first channel at a fifth elevation less than the third elevation, and a second end at a sixth elevation less than the fifth elevation, the first end being configured to receive the first portion of the objects exiting the first channel and to direct the first portion toward the second end;

a second deflector member spaced-apart from the second end of the second inclined member and disposed at a seventh elevation less than the sixth elevation, the second deflector member being arranged to deflect the first portion of the objects directed thereto from the second end of the second inclined member;

a second wall member spaced-apart from the second deflector member, such That the second deflector member is disposed between the second inclined member and the second wall member, the second wall member extending to an eighth elevation greater than the seventh elevation; and a second channel disposed between the second deflector member and the Second wall member, the second channel being configured to receive a first portion of the objects not being deflected over the second wall member by the second deflector member, the first portion of the objects received by the second channel thereby having the rejected status, and a second portion of the objects deflected over the second wall member by the second deflector member thereby having the accepted status.

3. An apparatus according to claim 2 further comprising:

a third object sorting arrangement in communication with the second channel of the second object sorting arrangement, and configured to receive the first portion of the objects therefrom, the third object sorting arrangement comprising:

a third inclined member having a first end in communication with the second channel at a ninth elevation less than the seventh elevation, and a second end at a tenth elevation less than the ninth elevation, the first end being configured to receive the first portion of the objects exiting the second channel and to direct the first portion toward the second end;

a third deflector member spaced-apart from the second end of the third Inclined member and disposed at an eleventh elevation less than the tenth elevation, the third deflector member being arranged to deflect the first portion of the objects directed thereto from the second end of the third inclined member;

a third wall member spaced-apart from the third deflector member, such that The third deflector member is disposed between the third inclined member and the third wall member, the third wall member extending to a twelfth elevation greater than the eleventh elevation; and a third channel disposed between the third deflector member and the third wall member, the third channel being configured to receive a first portion of the objects not being deflected over the third wall member by the third deflector member, the first portion of the objects received by the third channel thereby having the rejected status, and a second portion of the objects deflected over the third wall member by the third deflector member thereby having the accepted status.

4. An apparatus according to claim 3, wherein each inclined member is arranged so as to receive the objects, without deflection of the objects upon interaction with the respective inclined member.

5. An apparatus according to claim 3, wherein each inclined member is configured to impart lateral motion to the objects as the objects fall from the second end thereof toward the respective deflector member, each deflector member thereby being correspondingly laterally displaced with respect to the second end of the respective inclined member.

6. An apparatus according to claim 5, wherein each deflector member is configured to deflect the objects with at least a portion of the lateral motion imparted thereto by the respective inclined member, each wall member thereby being correspondingly laterally displaced with respect to the respective deflector member.

7. An apparatus according to claim 2, wherein the second inclined member is arranged in an inclination opposite to an inclination of the first inclined member.

8. An apparatus according to claim 3, wherein the third inclined member is arranged in an inclination opposite to an inclination of the second inclined member.

9. An apparatus according to claim 3, wherein objects having the accepted status are directed into an accepted object receptacle.

10. An apparatus according to claim 3, wherein any objects having the rejected status are directed into a rejected object receptacle in communication with the respective channel.

11. An apparatus according to claim 1, further comprising an agitation device operably engaged with the hopper assembly and configured to agitate the objects received therein so as to facilitate dispensation of the objects through the release port to the first inclined member.

12. An apparatus according to claim 1, further comprising a retention member operably engaged with the release port, the retention member being selectively actuatable to dispense the objects through the release port.

13. An apparatus according to claim 1, further comprising a cover member configured to oppose the first inclined member in a spaced-apart manner so as to form a channel therebetween for containing, within the channel, objects directed along the first inclined member.

14. An apparatus according to claim 1, wherein at least a portion of the first wall member is non-perpendicularly oriented with respect to the first deflector member.

15. A method for sorting objects as having one of an accepted and rejected status, the method comprising:

directing a plurality of objects from a hopper assembly through a release port associated therewith onto a first end of a first inclined member of a first object sorting arrangement, the first end being disposed at a first elevation; and directing the objects toward a second end of the first inclined member, the second end opposing the first end and being disposed at a second elevation less than the first elevation, and to a first deflector member spaced-apart from the second end of the first inclined member and disposed at a third elevation less than the second elevation, the first deflector member being arranged to deflect the objects directed thereto from the second end of the first inclined member, wherein a second portion of the objects deflected by the first deflector member over a first wall member have an accepted status, the first wall member being laterally spaced-apart from the first deflector member such that the first deflector member is laterally disposed between the first inclined member and the first wall member, and such that the first inclined member, the first deflector member, and the first wall member are each laterally spaced-apart from one another, the first wall member extending to a fourth elevation greater than the third elevation, and wherein a first portion of the objects not deflected over the first wall member by the first deflector member are received by a first channel disposed between the first deflector member and the first wall member and have a rejected status.

16. A method according to claim 15, further comprising:

directing the first portion of the objects from the first channel of the first object sorting arrangement to a first end of a second inclined member of a second object sorting arrangement, the first end of the second inclined member being disposed at a fifth elevation less than the third elevation; and directing the first portion toward a second end of the second inclined member, the second end opposing the first end and being disposed at a sixth elevation less than the fifth elevation, and to a second deflector member spaced-apart from the second end of the second inclined member and disposed at a seventh elevation less than the sixth elevation, the second deflector member being arranged to deflect the first portion of the objects directed thereto from the second end of the second inclined member, wherein a second portion of the objects deflected by the second deflector member over a second wall member, the second wall member being spaced-apart from the second deflector member such that the second deflector member is disposed between the second inclined member and the second wall member and extends to a eighth elevation greater than the seventh elevation, have an accepted status, and wherein a first portion of the objects not deflected over the second wall member by the second deflector member are received by a second channel disposed between the second deflector member and the second wall member and have a rejected status.

17. A method according to claim 16, further comprising:

directing the first portion of the objects from the second channel of the second object sorting arrangement to a first end of a third inclined member of a third object sorting arrangement, the first end of the third inclined member being disposed at a ninth elevation less than the sixth elevation; and directing the first portion toward a second end of the third inclined member, the second end opposing the first end and being disposed at a tenth elevation less than the ninth elevation, and to a third deflector member spaced-apart from the second end of the third inclined member and disposed at tenth elevation less than the ninth elevation, the third deflector member being arranged to deflect the first portion of the objects directed thereto from the second end of the third inclined member, wherein a second portion of the objects deflected by the third deflector member over a third wall member, the third wall member being spaced-apart from the third deflector member such that the third deflector member is disposed between the third inclined member and the third wall member and extends to an eleventh elevation greater than the tenth elevation, have an accepted status, and wherein a first portion of the objects not deflected over the third wall member by the third deflector member are received by a third channel disposed between the third deflector member and the third wall member and have a rejected status.

18. A method according to claim 17, further comprising arranging each inclined member so as to limit deflection of the objects upon interaction with the respective inclined member.

19. A method according to claim 17, further comprising imparting lateral motion, via each inclined member, to the objects, as the objects fall from the second end of the inclined member toward the respective deflector member, each deflector member thereby being correspondingly laterally displaced with respect to the second end of the respective inclined member.

20. A method according to claim 19, further comprising deflecting the objects, via each deflector member, with at least a portion of the lateral motion imparted thereto by the respective inclined member, each wall member thereby being correspondingly laterally displaced with respect to the respective deflector member.

21. A method according to claim 16, further comprising arranging the second inclined member in an inclination opposite to an inclination of the first inclined member.

22. A method according to claim 17, further comprising arranging the third inclined member in an inclination opposite to an inclination of the second inclined member.

23. A method according to claim 17, further comprising directing objects having the accepted status into an accepted object receptacle.

24. A method according to claim 17, further comprising directing any objects having the rejected status into a rejected object receptacle in communication with the respective channel.

25. A method according to claim 15, further comprising agitating the objects received within the hopper assembly, via an agitation device operably engaged with the hopper assembly, so as to facilitate dispensation of the objects through the release port to the first inclined member.

26. A method according to claim 15, further comprising selectively actuating a retention member operably engaged with the release port so as to dispense the objects through the release port.

27. A method according to claim 15, wherein directing a plurality of objects further comprises directing the objects into a containment channel of the first sorting arrangement, the containment channel being defined by a cover member opposed to the first inclined member in a spaced-apart manner for containing therein objects directed along the first inclined member.

28. A method according to claim 15, further comprising orienting at least a portion of the first wall member into a non-perpendicularly arrangement with respect to the first deflector member.

29. A method according to claim 15, wherein directing a plurality of objects further comprises directing a plurality of rupturable objects having a liquid payload from a hopper assembly through a release port associated therewith.

30. A method according to claim 15, wherein directing a plurality of objects further comprises directing a plurality of objects having a substantially spherical profile from a hopper assembly through a release port associated therewith.

* * * * *

UNITED STATES PATENT AND TRADEMARK OFFICE

CERTIFICATE OF CORRECTION

PATENT NO. : 8,905,243 B2
APPLICATION NO. : 12/854339
DATED : December 9, 2014
INVENTOR(S) : Darrell Dixon and Larry McCann It is certified that error appears in the above-identified patent and that said Letters Patent is hereby corrected as shown below:

Title page, item (56), col. 2, line 1, under Foreign Patent Documents, change "DE 10 2005 00827 8/2006" to -- DE 10 2005 008275 8/2006 --.

In the Claims,

In Claim 1, column 13, line 39, please change to -- a first deflector member laterally spaced-apart from the second --.

In Claim 1, column 13, line 45, please change to -- a first wall member laterally spaced-apart from the first deflector --.

In Claim 2, column 14, line 15, please change "That" to -- that --.

In Claim 2, column 14, line 21, please change "Second" to -- second --.

In Claim 3, column 14, line 44, please change "Inclined" to -- inclined --.

In Claim 3, column 14, line 50, please change "The" to -- the --.

In Claim 15, column 15, line 52, please change to -- first elevation, and to a first deflector member laterally spaced- --.

Signed and Sealed this
Thirtieth Day of June, 2015

Michelle K. Lee

Michelle K. Lee
*Director of the United States Patent and Trademark Office*